US007156257B2

(12) United States Patent
de la Serna

(10) Patent No.: US 7,156,257 B2
(45) Date of Patent: Jan. 2, 2007

(54) COMPRESSED GAS CYLINDER

(75) Inventor: Pedro E. de la Serna, San Jose, CA (US)

(73) Assignee: Alza Corporation, Mountain View, CA (US)

( * ) Notice: Subject to any disclaimer, the term of this patent is extended or adjusted under 35 U.S.C. 154(b) by 0 days.

(21) Appl. No.: 10/402,688

(22) Filed: Mar. 28, 2003

(65) Prior Publication Data

US 2003/0226845 A1 Dec. 11, 2003

(51) Int. Cl.
*B67D 5/00* (2006.01)

(52) U.S. Cl. ..... 222/5; 222/3; 222/81; 222/82; 222/541.4; 137/68.23; 137/68.25; 137/68.27; 280/737

(58) Field of Classification Search ..... 222/3, 222/5, 80–83, 83.5, 86, 88, 541.2, 541.4; 137/68.25–68.28, 68.13, 68.19, 68.21, 68.23; 220/203.08, 261, 89.2; 280/740–742, 736–737
See application file for complete search history.

(56) References Cited

U.S. PATENT DOCUMENTS

| | | | | |
|---|---|---|---|---|
| 2,425,448 | A | 8/1947 | Weida | |
| 2,498,147 | A * | 2/1950 | Alexander | 222/82 |
| 2,506,983 | A * | 5/1950 | Williams | 116/106 |
| 2,613,849 | A | 10/1952 | Ward | |
| 2,688,428 | A * | 9/1954 | Manhartsberger | 141/352 |
| 2,890,815 | A | 6/1959 | Corlet | |
| 3,675,722 | A * | 7/1972 | Balmes, Sr. | 169/30 |
| 3,777,789 | A | 12/1973 | Corlet | |
| 4,146,047 | A * | 3/1979 | Wood et al. | 137/68.26 |
| 4,913,699 | A * | 4/1990 | Parsons | 604/68 |
| 5,316,055 | A * | 5/1994 | Brimmer | 141/38 |
| 5,551,723 | A * | 9/1996 | Mahon et al. | 280/737 |
| 5,582,127 | A * | 12/1996 | Willis et al. | 116/210 |
| 5,597,091 | A * | 1/1997 | Mah et al. | 222/3 |
| 5,601,308 | A * | 2/1997 | Cuevas | 280/736 |
| 5,632,505 | A * | 5/1997 | Saccone et al. | 280/737 |
| 5,673,933 | A * | 10/1997 | Miller et al. | 280/736 |
| 5,673,934 | A * | 10/1997 | Saccone et al. | 280/737 |
| 5,678,856 | A * | 10/1997 | Headley | 280/737 |
| 5,711,547 | A * | 1/1998 | Blumenthal et al. | 280/737 |
| 5,845,811 | A * | 12/1998 | Shervington et al. | 222/3 |
| 6,047,865 | A | 4/2000 | Shervington et al. | |
| 6,096,002 | A | 8/2000 | Landau | |
| 6,295,935 | B1 * | 10/2001 | Swann et al. | 102/530 |

FOREIGN PATENT DOCUMENTS

| | | |
|---|---|---|
| DE | 32 05 264 A1 | 8/1983 |
| FR | 1 133 075 A | 3/1957 |
| GB | 1 070 715 A | 6/1967 |

OTHER PUBLICATIONS

International Search Report in PCT/US03/09493 dated Oct. 2, 2003.

* cited by examiner

*Primary Examiner*—Frederick C. Nicolas
(74) *Attorney, Agent, or Firm*—Angela N. Nwaneri

(57) ABSTRACT

The present invention provides a compressed gas cylinder that is capable of storing a compressed fluid at high pressures. The cylinder of the present invention includes a body terminating in an inwardly domed cap. The dome included in the cap of the compressed gas cylinder of the present invention is formed such that the material near the tip of the dome is relatively thinner than the material near the base of the dome. The tip of the dome, therefore, creates a pierce region in the cap that can be pierced through the application of a relatively low pressure.

5 Claims, 2 Drawing Sheets

COMPRESSED GAS CYLINDER

BACKGROUND

1. Field of the Invention

The present invention relates to compressed gas cylinders. In particular the present invention relates to a compressed gas cylinder including a cap having a domed area configured to reduce the force required to release the compressed gas stored within the cylinder.

2. Background of the Invention

Small compressed gas cylinders, or microcylinders, are well known in the art. Because they are capable of storing a considerable volume of a chosen gas at high pressure, microcylinders provide a compact but powerful energy source, and, as a result, microcylinders are presently used in a wide range of applications. For example, microcylinders are presently used as the energy source in emergency inflation devices, gas powered rifles and handguns, tire inflation devices, pneumatically driven injection devices, and even in devices for whipping cream. Despite being pressed into service in several different functional contexts, however, state of the art microcylinders are not ideally suited to each of the applications in which they are presently used.

In particular, state of the art microcylinders are not ideally suited for use in automatic injection devices, otherwise known as "autoinjectors." Autoinjectors are generally designed to facilitate quick, automatic, and accurate injection of a desired dose of a chosen medicament and are thought to be particularly well suited for use in emergency situations or by subjects who must regularly self-administer therapeutic substances. Where the design of the autoinjector or the nature of the medicament to be delivered by requires either that the autoinjector accelerate the medicament to a high velocity or that the autoinjector drive the medicament with a high injection force, microcylinders are thought to be ideal candidates as energy sources for the autoinjector. However, in order to release the compressed gas from within a microcylinder, the microcylinder must be pierced, or otherwise compromised, and the caps or seals typically included on microcylinders cannot be pierced without the application of relatively high force.

A standard microcylinder is illustrated in FIG. 1 through FIG. 3. The microcylinder illustrated in these figures is exemplary of microcylinders available through several commercial suppliers, such as Leland Limited, Inc., of South Plainfield, N.J. As can be seen in FIG. 1 through FIG. 3, the standard microcylinder 10 includes a body 12 terminating in a cap 14. In order to release the compressed gas stored within the microcylinder 10, the cap 14 is generally pierced, and to reduce the force necessary to pierce, the cap 14, the cap 14 may be-provided with an area of reduced thickness, or "pierce region" 16, where the cap may be pierced more easily (shown in cross-section in both FIG. 2 and FIG. 3). Because the pressure exerted by the gas stored in a standard microcylinder 10 places the material forming the pierce region 16 in tension (indicated by arrows 17), however, the extent to which the pierce region 16 can be thinned is limited, as the pierce region 16 must be sufficiently strong to resist tearing when exposed to the tensile forces exerted by the gas compressed within the microcylinder 10. Therefore, even where the cap 14 of a standard microcylinder 10 is provided with a pierce region 16, the force required to pierce the cap 14 can exceed fifteen pounds, or more.

To overcome the pierce force problem created by standard microcylinders, autoinjectors including standard microcylinders generally include a mechanism that facilitates the generation of a force sufficient to pierce the microcylinder cap. The mechanism itself may be designed to generate a force sufficient to pierce the microcylinder, as is exemplified in the autoinjector taught in U.S. Pat. No. 6,096,002, or the mechanism may simply impart a mechanical advantage sufficient to enable the user to exert the required pierce force through the exertion of a smaller force. Such mechanisms, however, are generally not desirable, as they may complicate the design of the autoinjector and may, in some cases, prove to be an inconvenience to the user.

In an attempt to cure the problems presented by the high pierce forces required by standard microcylinders, The BOC Group of Windlesham, United Kingdom, developed microcylinders including a frangible, or breakaway, cap. U.S. Pat. No. 5,845,811 ("the '811 Patent") and U.S. Pat. No. 6,047,865 ("the '865 Patent") are directed to two different breakaway microcylinders 18, 20 developed by the BOC Group, the two different designs being illustrated herein in FIG. 4 and FIG. 5. The first design 18, which is described in the '811 patent, includes a cylinder body 12, a cap 14 including a frangible area 22, a lever 24, and an anchor member 26. The cap 14 is compromised through application of a force to the lever 24, which causes the frangible area 22 to fracture. The second design 20, which is described in the '865 Patent, includes a microcylinder having a body 12, a cap 14 with a frangible area 22, and an elongated neck 28. The elongated neck 28 of the second design effectively replaces the lever 24 of the first design, with the frangible area 22 being fractured as a force is applied to the elongated neck 28. Relative to a standard microcylinder, the designs proposed in the '811 and '865 Patents reduce the amount of force that a user must apply to compromise the microcylinder.

However, like standard microcylinders, the breakaway microcylinders taught in the '811 and '865 patents are not without disadvantages. In particular, both the lever of the first design and the elongated neck of the second design are exposed, which increases the risk that the break-away microcylinders will be accidentally compromised, or "fired," as they are handled, for example, during transportor during a device assembly process. It would, therefore, be an improvement in the art to provide a gas cylinder that is not only capable of storing a compressed fluid or gas at high pressures, but which also includes a cap that is relatively difficult to accidentally fire and can be pierced through the application of a relatively small force.

SUMMARY OF THE INVENTION

The present invention provides a compressed gas cylinder that is capable of storing a compressed gas at high pressures. The compressed gas cylinder of the present invention includes a body terminating in an inwardly domed cap. The dome included in the cap of the compressed gas cylinder of the present invention is formed such that the material near the tip of the dome is relatively thinner than the material near the base of the dome. The tip of the dome, therefore, creates a pierce region in the cap that can be pierced through the application of a relatively low pressure. As it is used herein, the term "compressed gas cylinder" does not limit the scope of the present limitation and is used as a matter of convenience to refer to a container configured to contain or deliver a desired amount of a compressed fluid at a predetermined pressure or range of pressures. Moreover, as it is used in the present context, the term "fluid" refers to a compressible liquid or gas.

The inwardly domed cap provides advantages not achieved by standard microcylinders or breakaway microcylinders. For example, because the dome extends inwardly from the top of the cap, the pierce region produced by the dome is placed under compression. Placing the pierce region under compression, instead of tension, allows the pierce region to be thinned to a greater extent than is possible in a standard microcylinder, which, in turn, results in a reduction in the force required to penetrate the pierce region. Moreover, the inwardly facing dome is less prone to accidental firing than a breakaway mechanism including a lever or neck that extends outwardly and away from the cylinder cap or body. Therefore, the design of the compressed gas cylinder of the present invention not only allows for a reduction in the amount of force required to compromise the cylinder, but the design of the present invention also works to provide such a reduction in force without increasing the risk that the cylinder will be accidentally fired.

BRIEF DESCRIPTION OF THE DRAWINGS

FIG. 7 provides a schematic representation of a cross-section taken through the microcylinder illustrated in FIG. 6 at line A—A FIG. 8 provides an enlarged view of portion "B" of the cross section illustrated in

DETAILED DESCRIPTION OF THE INVENTION

Figure 1:
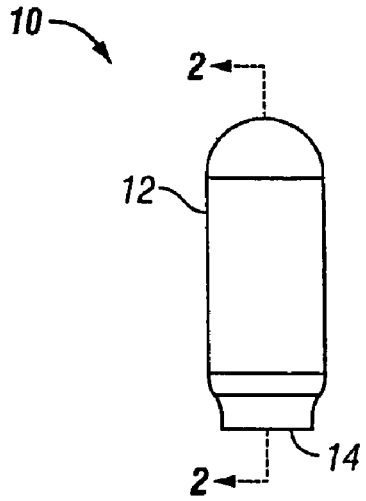
(PRIOR ART) FIG. 1
FIG. 1 provides a schematic representation of the exterior of a standard microcylinder, as known in the art.
Figure 2:
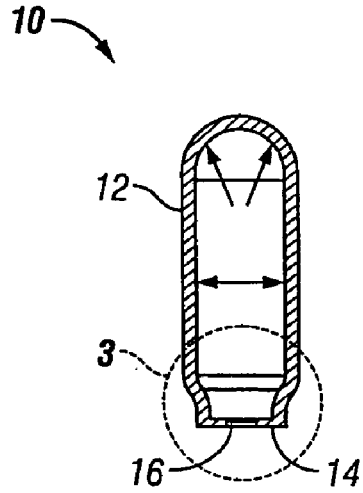
(PRIOR ART) FIG. 2
FIG. 2 provides a schematic representation of a cross-section taken through the microcylinder illustrated in FIG. 1 at line A—A FIG. 3 provides an enlarged view of portion "C" of the cross section illustrated in FIG. 2.
Figure 3:
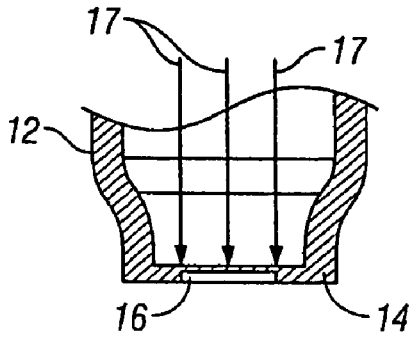
(PRIOR ART) FIG. 3
Figure 4:
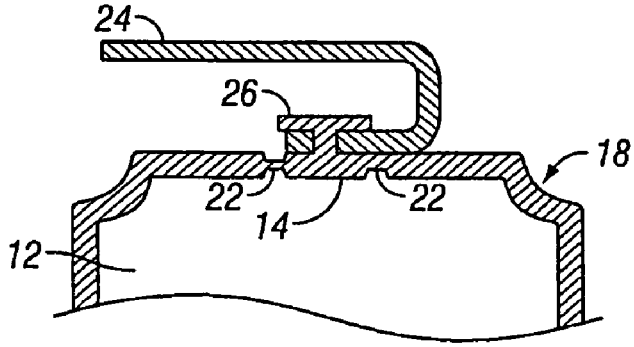
(PRIOR ART) FIG. 4
FIG. 4 provides a schematic representation of an exemplary breakaway microcylinder as taught in U.S. Pat. No. 5,845,811.
Figure 5:
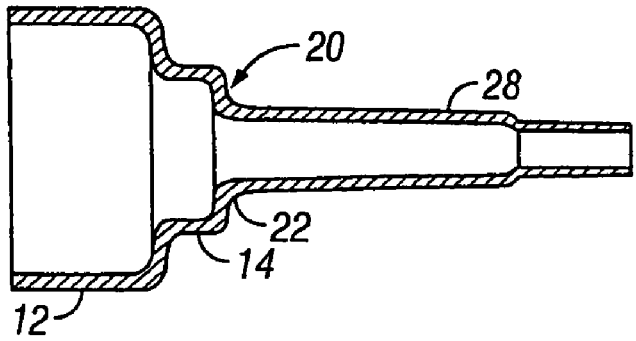
(PRIOR ART) FIG. 5
FIG. 5 provides a schematic representation of a second exemplary breakaway microcylinder, as taught in U.S. Pat. No. 6,047,865.
Figure 6:
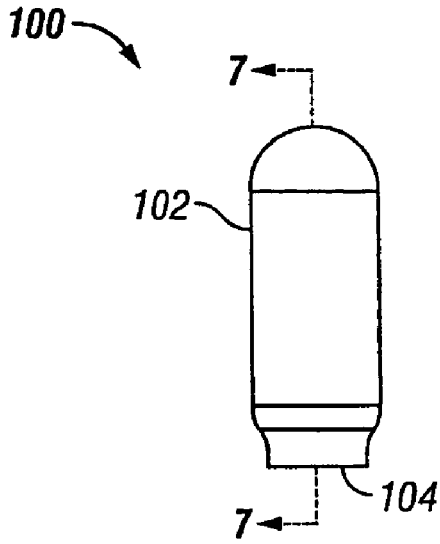
FIG. 6 provides a schematic representation of the exterior of a microcylinder according to the present invention.
Figure 7:
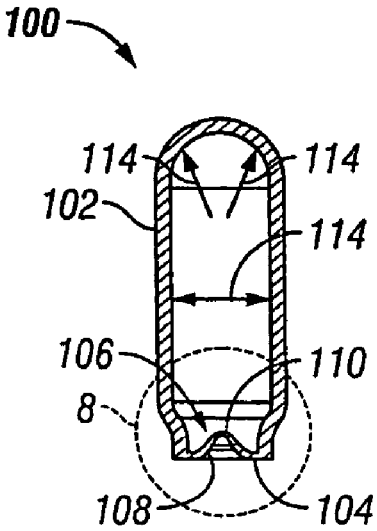
Figure 8:
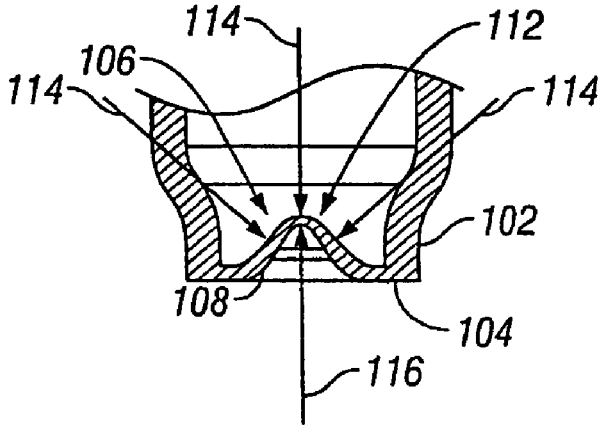

An exemplary compressed gas cylinder 100 according to the present invention is illustrated in FIG. 6 through FIG. 8. As can be seen by reference to FIG. 6, the compressed gas cylinder 100 of the present invention includes a body 102 that may appear substantially similar to a standard microcylinder in size and shape. However, unlike standard microcylinders, the compressed gas cylinder 100 of the present invention includes a cap 104 having an inwardly formed dome 106 (shown in cross-section in FIG. 7 and FIG. 8). Significantly, the dome 106 included in the cap 104 is formed such that the material near the base 108 of the cap 104 is thicker than the material at and near the tip 110 of the cap 104. Therefore, the material at and near the tip 110 of the cap 104 forms a pierce region 112 that is more easily penetrated than the material forming the remainder of the cap 104.

Advantageously, the design of the cap 104 of the compressed gas cylinder 100 of the present invention allows the pierce region 112 included in the dome 106 to be thinned to a greater extent than is possible for a pierce region included in a cap of a standard microcylinder. As shown in FIG. 8, the surface/pierce region 112 of the dome 106 presented to the compressed fluid stored within the compressed gas cylinder 100 is non-planar. By forming the dome 106 as an inwardly-facing structure, the pierce region 112 created by the dome 106 is placed under compression (indicated by force arrows 114), instead of tension, when exposed to the pressures exerted by a compressed fluid stored within the compressed gas cylinder 100. Forming the dome 116 such that the material forming the pierce region 112 is placed under compression is significant because a material of a given thickness is capable of withstanding a greater amount of pressure when the pressure exerted against the material places the material in compression rather than tension. Thus, while maintaining or improving the safety margin provided by the cylinder, the material forming the pierce region 112 provided in the compressed gas cylinder 100 of the present invention can be thinner than the material forming a pierce region provided in a standard microcylinder designed to withstand an identical pressure or range of pressures.

As the thickness of the pierce region 112 included in the cap 104 of compressed gas cylinder 100 is reduced, the force required to penetrate the pierce region 112 will decrease significantly. The thickness of the pierce region 112 of the compressed gas cylinder 100 of the present invention will vary depending on the materials used to fabricate the cap 104 and the inwardly-formed dome 106 included in the cap 104. However, the design of the inwardly-formed dome 106 of the compressed gas cylinder 100 of the present invention facilitates fabrication of a compressed gas cylinder having a pierce region that is up to, or more than, 50% thinner than what would be required in a microcylinder that includes a flat or planar pierce region, is fabricated using the same materials, and is designed to withstand an identical pressure or range of pressures. Therefore, the inwardly-formed dome 106 included in the cap 104 of the cylinder 100 of the present invention enables the creation of a cylinder having a pierce region that is penetrable using a significantly smaller force than would be necessary to penetrate the cap of a standard microcylinder designed to contain an identical volume of gas compressed at an identical pressure or range of pressures.

An additional advantage to the design of the compressed gas cylinder 100 of the present invention is that the inwardly formed design of the dome 106 also works to reduce the possibility of accidental firing. In contrast to cylinder or cap designs that ease firing of the cylinder by providing a lever or neck that extends out or away form the body of the cylinder, the dome 106 included in the cap 104 of the compressed gas cylinder 100 of the present invention extends inward from the general outline of the cylinder 100 and into the volume defined by the body 102. Therefore, when compared to force reduction mechanisms that include an exposed lever or a frangible neck, the pierce region 112 provided near the tip 110 of the inwardly-formed dome 106 of a compressed gas cylinder 100 of the present invention is positioned in a relatively more protected position within the cylinder 100.

The compressed gas cylinder 100 of the present invention may be manufactured using any suitable material formed by any suitable manufacturing process. For example, the body 102 and cap 104 of the compressed gas cylinder 100 may be created using a metal or metal alloy, such as an aluminum alloy, a titanium alloy, a stainless steel alloy, or carbon steel. The body 102 of the compressed gas cylinder 100 may be formed, for example, of a drawn metal or metal alloy that is shaped using a conventional stamp and die process. The cap 104 of the compressed gas cylinder 100 of the present invention may be manufactured by, for example, providing a planar piece of a material compatible to the body 102 of the compressed gas cylinder 100 that is sized and shaped appropriately. The dome 106 provided in the cap 104 may be formed using a second stamp and die process. Where the dome 106 is formed by a second stamp and die process, such a process may form the desired dome 106 using a single hit from a single die, or, alternatively, using two or more successive hits from a single die or a series of progressively sized dies. Once both the body 192 and the cap 104 of the compressed gas cylinder 100 of the present invention are formed, the compressed gas cylinder 100 may be filled with a desired amount of a chosen material and the body 102 and the cap 104 may be joined using any suitable process, such as, for example, a known welding or bonding process.

Though any suitable method may be used to form the dome 106 included in the cap 104 of the compressed gas cylinder 100 of the present invention, a stamp and die process is presently preferred. Beyond providing a dome 106 with a thinned pierce region 112 at the tip 110, it is believed that creating the dome 106 using a stamp and die process brings the material forming the pierce region 112 of the dome 106 closer to its yield point in the direction of penetration (indicated by arrow 116). As the material forming the dome 106 is hit with one or more dies, the material of the cap 104 is stretched to form the dome 106, with the material forming the pierce region 112 stretching to the greatest extent, and as the material is stretched to form the dome 106, it is brought closer to its yield point. In general, a material stretched closer to its yield point is less resilient to the application of force and will generally yield more readily than a material that has not been stretched. Therefore, it is believed that forming the dome 106 included in the cap 104 of the compressed gas cylinder 100 of the present invention using a stamp and die process will reduce the force required to penetrate the pierce region 112 of dome 106 relative to a process providing an equally thick pierce region formed of a non-yielded material.

As is easily appreciated, the compressed gas cylinder 100 of the present invention may be designed for use in any desired context. For example, the cylinder may be fabricated to contain virtually any amount of a variety of compressed gases or liquids at a desired pressure or range of pressures. Examples of compressible substances that may be contained and delivered from a compressed gas cylinder according to the present invention include, but are not limited to, $CO_2$, helium, nitrogen, and CDA (Clean Dry Air). Therefore, the size of the compressed gas cylinder 100 may be modified, as needed, to suit a particular storage and delivery need or a particular range of storage and delivery needs. Moreover, the specifications of the various features of the compressed gas cylinder 100 are easily modified to provide a cylinder of sufficient strength to match a desired storage or delivery need. For example, the body 102 and cap 104 may be formed of thicker or thinner material to suit a particular storage need, and the dome 106 included in the cap 104 can be modified to provide a pierce region 112 offering a desired balance between safety and piercing ease. Finally, though a generally cylindrical shape is preferred for the compressed gas cylinder 100 of the present invention, the shape of the device need not be cylindrical. The form of the compressed gas cylinder 100 of the present invention may be modified from that illustrated in FIG. 6 through FIG. 8, as desired, to suit a particular application. Regardless of the precise specifications, however, the cylinder 100 of the present invention facilitates the manufacture of a cylinder capable of storing and delivering a desired amount of compressed gas at high pressure, while reducing the force required to fire the cylinder. Moreover, the relatively protected positioning of the pierce region included in a compressed gas cylinder of the present invention works to decrease the likelihood that the cylinder will be accidentally compromised relative to force reduction mechanisms that require an exposed lever or frangible neck.

I claim:

1. A container for storage and delivery of a compressed fluid, the container comprising:

a body configured to contain a desired amount of a compressed fluid; and a dome structure disposed at an end of the body, the dome structure extending inwardly into a volume generally defined by the body and the dome structure and presenting a non-planar surface to the compressed fluid in the volume such that the compressed fluid in the volume exerts pressure on the dome structure in opposing directions, thereby placing the dome structure under compression before the dome structure is pierced, the dome structure having a tip which defines a pierce region, wherein the pierce region has a thinner wall than the remainder of the dome structure and is more easily penetrated than the remainder of the dome.

2. The container of claim 1, wherein the body includes a first end and a second end and at least one of the first end and the second end includes the dome structure.

3. The container of claim 1, further comprising a cap in which the dome structure is provided, the cap and the body being configured such that the cap is attachable to the body.

4. The container of claim 1, wherein the body and the pierce region comprise a metal selected from the group comprising an aluminum alloy, a titanium alloy, a stainless steel alloy, or carbon steel.

5. The container of claim 3, wherein the body and the cap comprise a metal selected from the group comprising an aluminum alloy, a titanium alloy, a stainless steel alloy, or carbon steel.

* * * * *